United States Patent [19]

Alexander et al.

[11] Patent Number: 4,511,463

[45] Date of Patent: Apr. 16, 1985

[54] PROCESS FOR RECOVERY OF PHOSPHATE ORE

[75] Inventors: Edward N. Alexander; Richard Smith, both of Opelika, Ala.

[73] Assignee: West-Point Pepperell, Inc., West Point, Ga.

[21] Appl. No.: 965,394

[22] Filed: Dec. 1, 1978

Related U.S. Application Data

[63] Continuation of Ser. No. 809,632, Jun. 24, 1977, abandoned.

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,099,120 | 11/1937 | Kirby | 209/166 |
| 2,120,217 | 6/1938 | Harris | 209/166 |
| 2,312,466 | 3/1943 | Erickson | 209/166 |
| 4,081,363 | 3/1978 | Grayson | 209/166 |
| 4,148,720 | 4/1979 | Wang | 209/166 |
| 4,200,522 | 4/1980 | Dorrepaal | 209/166 |

*Primary Examiner*—Bernard Nozick

*Attorney, Agent, or Firm*—Cushman, Darby & Cushman

[57] ABSTRACT

Phosphate ore is concentrated by flotation in the presence of a half-ester of an organic dicarboxylic acid, such as maleic acid, with a saturated aliphatic alcohol containing at least 11 carbon atoms. Water and oil also are present. The half-ester may be partly neutralized, e.g. with caustic soda, in an amount at most sufficient to raise the pH to 7.0.

3 Claims, 1 Drawing Figure

PROCESS FOR RECOVERY OF PHOSPHATE ORE

Figure 1:
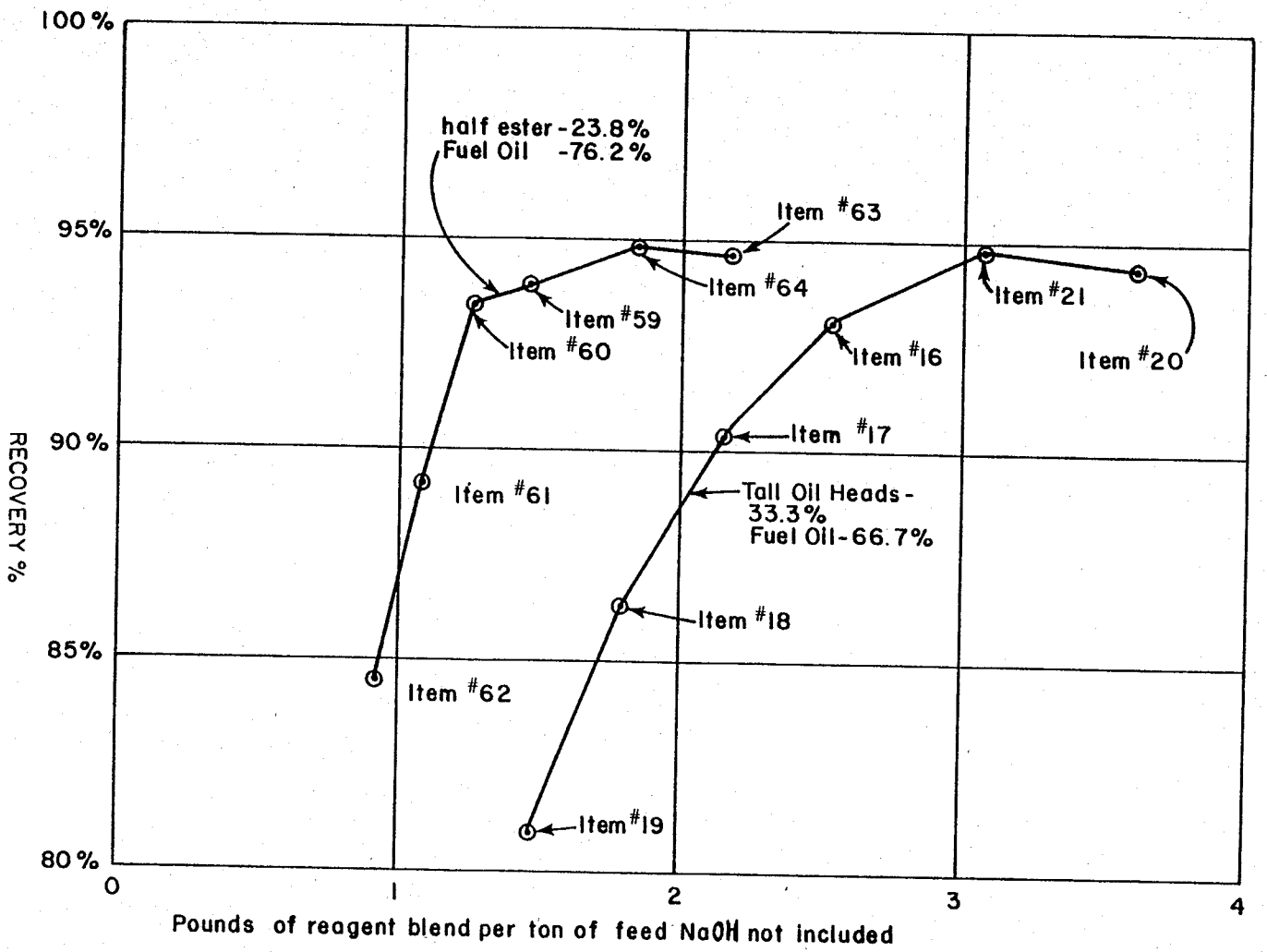

This is a continuation of application Ser. No. 809,632, filed June 24, 1977, now abandoned.

The present invention relates to the process of recovering phosphate from phosphate ores.

Phosphate ore contains about 30% BPL (bone phosphate of lime—$Ca_3(PO_4)_2$), and large amounts of silica. Large tonnages of this ore are mined in Florida. After crushing and removal of a very coarse fraction, the ore is sized to provide a fraction of the +150 mesh, the −150 mesh slime being discarded. A fraction of about −14 to +150 mesh is conditioned with fatty acid (usually tall oil fatty acid), fuel oil and caustic soda (NaOH) and floated by a conventional froth flotation process. The underflow usually is treated further with sulfuric acid to remove collector coatings, deslimed, washed of reagents and subjected to flotation with amine and fuel oil at pH 7–8. The latter flotation raises the final concentrate grade.

In accordance with the present invention, it has been discovered that the efficiency of the process in terms of the amount of reagents used is improved if the acid used in the first flotation is a half ester of a dicarboxylic acid and a long chain aliphatic alcohol.

The half esters of dicarboxylic acid used in the present invention can contain a variety of dicarboxylic acids, including maleic acid, fumaric acid and succinic acids. Preferably, the acid contains fewer than 5 carbon atoms and is a linear aliphatic saturated or unsaturated dicarboxylic acid.

It will be appreciated, of course, that while the half-esters are characterized in terms of a dicarboxylic acid, they may be produced from the corresponding anhydrides, or other ester-forming derivatives. In fact, a convenient method of preparation is to simply heat equimolar amounts of the alcohol and anhydride since the reaction usually stops after one carboxyl group reacts.

The alcohols utilized in said esters are preferably aliphatic, saturated or unsaturated alcohols containing at least 11 carbon atoms. Preferably the alcohols contain 11 to 21 carbon atoms.

The flotation process is carried out in the conventional manner, i.e. in a conventional flotation machine. See Encyclopedia of Chemical Technology, 2nd Ed., Vol. 9, page 392. The flotation liquid is water and, in addition to the half ester, an alkali (normally caustic soda) and a frothing agent such as kerosene or fuel oil are also present. Other strong water-soluble bases may be used in lieu of caustic soda, such as sodium carbonate but on grounds of cost and effectiveness, caustic soda is preferred. The fuel oil used in the present invention may be of the type conventionally used in phosphate ore flotation, i.e., a liquid petroleum fraction, preferably No. 5 fuel oil—See Encyclopedia of Chemical Technology, Vol. 15, Second Ed., page 88 for the specifications of such oils.

The quantities of these materials are preferably as follows (percentages are given on a weight basis, based on the weight of the ore treated).

Fuel Oil 0.014 to 0.082%

Caustic Soda sufficient to adjust concentration to pH 6.8–7.0

Half-ester 0.013 to 0.026%

The following examples illustrate the preparation of half-esters. In each case, the specified quantities of alcohol and anhydride were simply heated to a temperature of about 130°–140° C. In some cases, the reaction mixture separated into two layers. In those cases, the flotation reagent preferably was taken from the upper layer.

| Item No. | Acid | Moles | Alcohol | Moles | Molar Ratio Alcohol:acid |
|---|---|---|---|---|---|
| 1 | Maleic anhydride | 1.41 | HOE | 1.41 | 1:1 |
| 2 | Maleic anhydride | 1.0 | HOE | 1.0 | 1:1 |
| 3 | Maleic anhydride | 0.51 | HOE | 1.06 | 2:08:1 |
| 4 | Maleic anhydride | 0.56 | HOE<br>Epal 20 | .805<br>.06 | 1.53:1 |
| 5 | Maleic anhydride | 2.18 | Epal 20<br>HOE | .28<br>1.9 | 1:1 |
| 6 | Maleic anhydride | 1.8 | Epal 20<br>HOE | .56<br>1.27 | 1:1 |
| 7 | Maleic anhydride | 2.1 | Epal 20<br>Epal 810<br>HOE | .56<br>.68<br>.85 | 1:1 |

In the foregoing table, "HOE" refers to "heavy oxo ends", a crude mixture of aliphatic alcohols produced from olefines by the oxo process and having a molecular weight of about 236. Epal 20 is a commercial mixture of hydrocarbons (30%) and aliphatic alcohols (70%) of molecular weight about 536. Epal 810 is a commercial mixture of aliphatic alcohols of molecular weight about 146.

A series of experiments, as tabulated below, was carried out in a conventional laboratory flotation cell (Wemco Fagregen Ore Flotation Machine), using water as the flotation medium and about 500 grams of ore. Unless otherwise indicated, the ore was a crude ore from which coarse materials, larger than about 15 mesh, had been removed. In all cases, unless otherwise noted, the cell was operated at 2300 rpm with the air flow adjusted for maximum flow. In some cases, designated "cleaner float", the initial concentrate was refloated and, in some cases (designated "triple float"), the concentrate from the second flotation was refloated. The last-mentioned process is less preferred as the product was not suitable for use without more processing. The ores were analyzed for concentration of solubles, by treatment with boiling hydrochloric acid (15%), the amount of ore dissolved being recorded in the table. Recovery percentages were calculated based on the proportion of the solubles of the original ore which was collected in the final concentrate. The tabulation also includes control experiments, in which a conventional agent containing tall oil fatty acids (designated TOH) was used. In the other experiments, the treating agents were those produced in accordance with the foregoing examples.

TABLE I

| Item | Feed % | Concentrate | | Tails | Recovery | Acid | | Fuel | 10% NaOH | |
|---|---|---|---|---|---|---|---|---|---|---|
| No. | Soluble | % Soluble | Wt % | % | % | Type | Ml | Oil | Ml | |
| 8 | 28.5 | 92.0 | 28.0 | 3.8 | 90.4 | TOH | .5 | 1.0 | .62 | Cleaner float |
| 9 | 28.6 | 92.7 | 28.3 | 3.4 | 91.5 | TOH | .666 | 1.33 | .8 | Triple float |

TABLE I-continued

| Item No. | Feed % Soluble | Concentrate % Soluble | Concentrate Wt % | Tails % | Recovery % | Acid Type | Acid Ml | Fuel Oil | 10% NaOH Ml | |
|---|---|---|---|---|---|---|---|---|---|---|
| 10 | 28.6 | 93.1 | 27.4 | 4.3 | 89.1 | TOH | .333 | .667 | .4 | Cleaner float |
| 11 | 29.4 | 95.9 | 22.7 | 9.8 | 74.3 | TOH | .25 | .5 | .3 | Cleaner float |
| 12 | 28.9 | 87.4 | 30.2 | 3.6 | 91.3 | TOH | .2 | .4 | .24 | Single float |
| 13 | 58 | 96.5 | 51.9 | 16.5 | 86.3 | TOH | .575 | 1.15 | .75 | Cleaner float Sized feed +50, −18 mesh |
| 14 | 58.4 | 96.0 | 57.5 | 7.7 | 94.4 | TOH | .575 | 1.15 | .6 | Cleaner float Sized feed +50, −18 mesh |
| 15 | 29.6 | 94.8 | 25.4 | 7.4 | 81.4 | TOH | .25 | .5 | .25 | Cleaner float |
| 16 | 29.8 | 87.2 | 31.8 | 3.0 | 93.1 | TOH | .233 | .466 | .27 | Single float |
| 17 | 29.4 | 86.6 | 30.7 | 4.1 | 90.3 | TOH | .2 | .4 | .23 | Single float |
| 18 | 30.0 | 88.7 | 29.2 | 5.8 | 86.3 | TOH | .167 | .333 | .2 | Single float |
| 19 | 30.0 | 91.4 | 26.5 | 7.9 | 80.7 | TOH | .133 | .267 | .15 | Single float |
| 20 | 30.0 | 84.6 | 33.5 | 2.5 | 94.4 | TOH | .33 | .667 | .38 | Single float |
| 21 | 29.8 | 84.2 | 33.6 | 2.3 | 94.9 | TOH | .283 | .567 | .33 | Single float |
| 22 | 29.5 | 94.9 | 23.4 | 9.5 | 75.3 | TOH | .167 | .333 | .2 | Cleaner float |
| 23 | 30.3 | 94.0 | 27.2 | 6.6 | 84.1 | TOH | .233 | .467 | .27 | Cleaner float |
| 24 | 30.0 | 92.9 | 29.2 | 4.1 | 90.3 | TOH | .283 | .567 | .33 | Cleaner float |
| 25 | 29.7 | 91.9 | 29.5 | 3.7 | 91.2 | TOH | .333 | .667 | .38 | Cleaner float |
| 26 | 59.3 | 96.3 | 54.9 | 14.3 | 89.1 | TOH | .333 | .667 | .39 | Sized feed, +50, −18 mesh, Cleaner float |
| 27 | 59.9 | 93.6 | 61.9 | 5.1 | 96.8 | TOH | .5 | 1.0 | .58 | Sized feed, +50, −18 mesh, Cleaner float |
| 28 | 57.5 | 94.5 | 58.3 | 5.8 | 95.8 | TOH | .5 | 1.0 | .58 | Sized feed, +50, −18 mesh, Cleaner float |
| 29 | 18.6 | 92.4 | 16.8 | 3.7 | 83.4 | TOH | .167 | .333 | .19 | Sized feed, +50, −18 mesh, Cleaner float |
| 30 | 20.3 | 92.2 | 19.9 | 2.4 | 90.6 | TOH | .25 | .5 | .29 | Sized feed, −50 mesh, Cleaner float |
| 31 | 29.4 | 77.0 | 34.9 | 3.9 | 91.4 | TOH | .333 | .667 | .39 | Single float, 15,000 ml/min 100 on gauge |
| 32 | 30.0 | 78.2 | 33.2 | 6.3 | 86.4 | TOH | .333 | .667 | .39 | Single float, 75 on gauge 10,400 ml/min |
| 31 | 29.1 | 82.1 | 31.7 | 4.6 | 89.2 | TOH | .333 | .667 | .39 | Single float, 6300 ml/min, 50 on gauge |
| 32 | 29.1 | 77.1 | 29.9 | 8.6 | 79.3 | TOH | .333 | .667 | .39 | Single float, 2800 ml/min 25 on gauge |
| 33 | 30.1 | 76.5 | 33.9 | 6.3 | 86.1 | TOH | .667 | 1.333 | .8 | Single float, 2800 ml/min 25 on gauge |
| 34 | 30.4 | 79.0 | 35.9 | 3.1 | 93.4 | GD-253 | .048 | | | |
| | | | | | | TOH | .167 | .486 | .2 | Single float |
| 35 | 29.3 | 78.2 | 33.9 | 4.2 | 90.5 | GD-253 | .024 | | | |
| | | | | | | TOH | .25 | .576 | .3 | Single float |
| 36 | 31.4 | 83.6 | 35.4 | 2.9 | 94.0 | GD-253 | .0714 | | | |
| | | | | | | TOH | .0833 | .395 | .1 | Single float |
| 37 | 30.8 | 84.3 | 34.0 | 3.3 | 92.9 | TOH | .333 | .667 | .32 | Single float |

A series of experiments, as tabulated below, was carried out in a conventional laboratory flotation cell (Wemco Fagregen Ore Flotation Machine), using water as the flotation medium and about 500 grams of ore. Unless otherwise indicated, the ore was a crude ore from which coarse materials, larger than about 15 mesh, had been removed. In all cases, unless otherwise noted, the cell was operated at 2300 rpm with the air flow adjusted for maximum flow. In some cases, designated "cleaner float", the initial concentrate was refloated, and in some cases, designated "triple float", the concentrate from the second flotation was refloated. The ores were analyzed for concentration of solubles, by treatment with boiling hydrochloric acid (%), the amount of ore dissolved being recorded in the table. Recovery percentages were calculated based on the proportion of the solubles of the original ore which was collected in the final concentrate. The tabulation also includes control experiments in which a conventional agent containing tall oil fatty acids (designated TOH) was used. In the other experiments, the treating agents were those produced in accordance with the foregoing examples.

TABLE I

| Item No. | Feed % Soluble | Concentrate % Soluble | Concentrate Wt % | Tails % | Recovery % | Acid Type | Acid Ml | Fuel Oil | 10% NaOH Ml | |
|---|---|---|---|---|---|---|---|---|---|---|
| 38 | 30.6 | 91.9 | 30.4 | 3.8 | 91.4 | 1 | .2 | 0.7 | 0.2 | Cleaner float |
| 39 | 29.5 | 92.3 | 28.9 | 3.9 | 90.6 | 1 | .3 | 1.05 | 0.3 | Triple float |

TABLE I-continued

| Item No. | Feed % Soluble | Concentrate % Soluble | Concentrate Wt % | Tails % | Recovery % | Acid Type | Acid Ml | Fuel Oil | 10% NaOH Ml | |
|---|---|---|---|---|---|---|---|---|---|---|
| 40 | 28.9 | 90.1 | 30.5 | 2:0 | 95.2 | 1 | .2 | .7 | .2 | Cleaner float |
| 41 | 28.8 | 91.8 | 29.4 | 2.6 | 93.6 | 1 | .15 | .53 | .15 | Cleaner float |
| 42 | 29.0 | 92.6 | 28.8 | 3.3 | 91.9 | 1 | .1 | .35 | .1 | Cleaner float |
| 43 | 29.3 | 89.1 | 29.8 | 4.0 | 90.4 | 1 | .075 | .26 | .075 | Single float |
| 44 | 28.9 | 92.8 | 28.6 | 3.3 | 91.8 | 1 | .075 | .26 | .075 | Cleaner float |
| 45 | 28.5 | 94.5 | 25.8 | 5.6 | 85.5 | 1- | .05 | .175 | .05 | Cleaner float |
| 46 | 56.7 | 95.4 | 57.2 | 4.9 | 96.3 | 1 | .17 | .6 | .17 | Cleaner float, sized feed +50−18 mesh |
| 47 | 28.4 | 94.1 | 27.0 | 4.0 | 89.7 | 1 | .075 | .26 | .075 | Cleaner float |
| 48 | 28.6 | 94.2 | 27.3 | 3.9 | 90.1 | 1 | .075 | .26 | .06 | Cleaner float |
| 49 | 29.4 | 93.7 | 28.4 | 3.9 | 90.5 | 1 | .075 | .26 | .05 | Cleaner float |
| 50 | 28.3 | 93.3 | 27.6 | 3.5 | 91.0 | 2 | .075 | .26 | .075 | Cleaner float |
| 51 | 28.2 | 94.1 | 27.2 | 3.6 | 90.7 | 2 | .075 | .26 | .1 | Cleaner float |
| 52 | 29.0 | 94.9 | 26.8 | 4.8 | 87.9 | 2 | .075 | .26 | .075 | Cleaner float |
| 53 | 28.8 | 95.1 | 25.4 | 6.2 | 83.9 | 3 | .15 | .4 | .1 | Cleaner float |
| 54 | 29.7 | 93.4 | 28.5 | 4.4 | 89.4 | 4 | .15 | .4 | .1 | Cleaner float |
| 55 | 28.5 | 94.3 | 26.5 | 4.7 | 87.9 | 4 | .1 | .27 | .07 | Cleaner float |
| 56 | 56.7 | 95.8 | 55.2 | 8.4 | 93.3 | 4 | .3 | .8 | .2 | Cleaner float sized feed, +50−18 mesh |
| 57 | 28.4 | 93.2 | 27.3 | 4.0 | 89.8 | 2 | .075 | .26 | .075 | Cleaner float |
| 58 | 29.5 | 93.9 | 26.7 | 6.0 | 85.1 | 2 | .075 | .26 | .1 | Cleaner float |
| 59 | 29.1 | 88.5 | 30.9 | 2.6 | 93.8 | 2 | .095 | .305 | .1 | Single float |
| 60 | 29.0 | 89.2 | 30.3 | 2.8 | 93.3 | 2 | .083 | .266 | .09 | Single float |
| 61 | 28.5 | 89.6 | 28.4 | 4.3 | 89.2 | 2 | .071 | .229 | .075 | Single float |
| 62 | 30.1 | 90.9 | 28.0 | 6.5 | 84.5 | 2 | .059 | .19 | .063 | Single float |
| 63 | 30.0 | 88.0 | 32.2 | 2.4 | 94.6 | 2 | .14 | .46 | .15 | Single float |
| 64 | 30.4 | 87.1 | 33.2 | 2.3 | 94.9 | 2 | .12 | .38 | .125 | Single float |
| 65 | 29.3 | 93.7 | 26.3 | 6.3 | 84.2 | 2 | .071 | .229 | .075 | Cleaner float |
| 66 | 30.2 | 92.7 | 29.6 | 3.9 | 90.9 | 2 | .095 | .305 | .1 | Cleaner float |
| 67 | 29.7 | 92.0 | 29.7 | 3.4 | 92.0 | 2 | .12 | .38 | .125 | Cleaner float |
| 68 | 28.8 | 92.1 | 29.7 | 2.1 | 94.9 | 2 | .14 | .46 | .15 | Cleaner float |
| 69 | 59.4 | 97.4 | 38.5 | 35.7 | 63.1 | 2 | .12 | .38 | .125 | Sized +50 −18 mesh, Cleaner float |
| 70 | 58.0 | 97.0 | 48.5 | 21.3 | 81.1 | 2 | .13 | .42 | .14 | Sized +50 −18 mesh, Cleaner float |
| 71 | 56.6 | 95.5 | 53.0 | 12.9 | 89.3 | 2 | .14 | .46 | .15 | Sized +50 −18 mesh, Cleaner float |
| 72 | 57.7 | 94.9 | 57.4 | 7.6 | 94.4 | 2 | .17 | .53 | .175 | Sized +50 −18 mesh, Cleaner float |
| 73 | 50.0 | 96.4 | 58.2 | 9.2 | 93.6 | 2 | .13 | .42 | .18 | Sized +50 −18 mesh, Cleaner float |
| 74 | 59.1 | 94.4 | 54.4 | 17.0 | 86.9 | 2 | .13 | .42 | .22 | Sized +50 −18 mesh, Cleaner float |
| 75 | 29.8 | 93.8 | 25.1 | 8.4 | 78.9 | 2 | .071 | .229 | .075 | Cleaner float |
| 76 | 29.4 | 93.1 | 26.8 | 6.2 | 84.6 | 2 | .071 | .229 | .085 | Cleaner float |
| 77 | 30.2 | 93.7 | 26.1 | 7.8 | 80.9 | 2 | .071 | .229 | .095 | Cleaner float |
| 78 | 29.6 | 94.7 | 24.1 | 8.9 | 77.2 | 2 | .071 | .229 | .115 | Cleaner float |
| 79 | 57.2 | 95.1 | 57.3 | 6.4 | 95.2 | 2 | .17 | .53 | .175 | Sized +50 −18 mesh, Cleaner float |
| 80 | 21.8 | 92.8 | 21.1 | 2.9 | 89.5 | 2 | .048 | .152 | .05 | Sized −50 mesh, Cleaner float |
| 81 | 21.7 | 92.2 | 22.1 | 1.7 | 93.9 | 2 | .059 | .19 | .062 | Sized −50 mesh, Cleaner float |
| 82 | 29.4 | 93.1 | 28.1 | 4.5 | 89.0 | 2 | .071 | .229 | .075 | Cleaner float |
| 83 | 28.5 | 93.2 | 26.5 | 5.2 | 86.6 | 2 | .071 | .429 | .075 | Cleaner float |
| 84 | 31.0 | 81.1 | 36.5 | 2.2 | 95.5 | 2 | .095 | .305 | .025 | Single float |
| 85 | 30.8 | 89.2 | 30.5 | 5.1 | 88.5 | 2 | .059 | .19 | .016 | Single float |
| 86 | 30.3 | 87.9 | 31.1 | 4.3 | 90.2 | 2 | .071 | .229 | .017 | Single float |
| 87 | 30.3 | 86.1 | 32.7 | 3.1 | 93.1 | 2 | .083 | .267 | .022 | Single float |
| 88 | 30.9 | 85.1 | 34.8 | 1.9 | 96.0 | 2 | .095 | .305 | .025 | Single float |
| 89 | 30.9 | 90.8 | 28.6 | 6.8 | 84.3 | 2 | .059 | .19 | .016 | Single float |
| 90 | 30.8 | 87.5 | 31.6 | 4.5 | 90.0 | 2 | .071 | .229 | .019 | Single float |
| 91 | 30.3 | 86.7 | 33.3 | 2.1 | 95.3 | 2 | 0.95 | .305 | .025 | Single float |
| 92 | 31.3 | 89.5 | 30.2 | 6.1 | 86.4 | 2 | .071 | .229 | .08 | Single float |
| 93 | 27.8 | 88.4 | 30.2 | 4.4 | 89.7 | 2 | .071 | .229 | .06 | Single float |
| 94 | 30.6 | 87.3 | 32.1 | 3.8 | 91.6 | 2 | .071 | .229 | .04 | Single float |
| 95 | 30.5 | 87.6 | 33.0 | 2.4 | 94.7 | 2 | .071 | .229 | .02 | Single float |
| 96 | 29.8 | 87.0 | 31.8 | 3.2 | 92.7 | 2 | .071 | .229 | .01 | Single float |
| 97 | 30.1 | 87.7 | 30.6 | 4.6 | 89.4 | 2 | .0625 | .125 | .017 | Single float |
| 98 | 29.9 | 85.1 | 32.0 | 3.9 | 91.1 | 2 | .0625 | .1875 | .017 | Single float |
| 99 | 30.8 | 88.5 | 31.6 | 4.2 | 90.7 | 2 | .0625 | .25 | .017 | Single float |

TABLE I-continued

| Item No. | Feed % Soluble | Concentrate % Soluble | Concentrate Wt % | Tails % | Recovery % | Acid Type | Acid Ml | Fuel Oil | 10% NaOH Ml | |
|---|---|---|---|---|---|---|---|---|---|---|
| 100 | 29.8 | 88.0 | 30.8 | 3.9 | 90.9 | 2 | .0625 | .3125 | .017 | Single float |
| 101 | 30.0 | 85.1 | 33.3 | 2.5 | 94.4 | 5 | .095 | .305 | .025 | Single float |
| 102 | 30.4 | 88.4 | 30.7 | 4.7 | 89.3 | 5 | .071 | .229 | .02 | Single float |
| 103 | 29.2 | 85.9 | 31.6 | 3.0 | 93.0 | 6 | .095 | .305 | .025 | Single float |
| 104 | 29.3 | 86.6 | 29.5 | 5.3 | 87.3 | 6 | .071 | .229 | .018 | Single float |
| 105 | 30.6 | 84.5 | 33.1 | 3.9 | 91.5 | 7 | .095 | .305 | .025 | Single float |
| 106 | 30.3 | 83.8 | 29.7 | 7.7 | 82.1 | 7 | .071 | .229 | .017 | Single float |
| 107 | 30.2 | 87.7 | 31.4 | 3.9 | 91.2 | | | | .025 | Single float |
| 108 | 30.8 | 85.4 | 33.6 | 3.1 | 93.3 | | | | .03 | Single float |
| 109 | 30.2 | 86.4 | 32.6 | 3.0 | 93.3 | 2 | .095 | .305 | .025 | Single float |
| 110 | 29.9 | 84.9 | 33.4 | 2.0 | 95.1 | 2 | .12 | .38 | .03 | Single float |

Based on the foregoing experiments, a comparison was made between the agents of the present invention and the conventional agent to determine the relative amounts of raw materials used. Tables 2 and 3 compare relative amounts of reagent used, in pounds, per ton of ore feed. The data is derived from the designated items in the foregoing tables. The data was calculated in accordance with the following formula: [ml ester or TOH+ml fuel oil] [0.9][4]=pounds reagent per ton of feed. This is based on a 500 gram sample run in the flotation cell and a specific gravity of 0.9 for the reagent blend:

TABLE 2

| Item # | Pounds Half Ester & Fuel Oil | % Recovery |
|---|---|---|
| 62 | 0.9 | 84.5 |
| 61 | 1.08 | 89.2 |
| 60 | 1.26 | 93.3 |
| 59 | 1.44 | 93.8 |
| 64 | 1.80 | 94.9 |
| 63 | 2.16 | 94.6 |

TABLE 3

| Item # | Pounds TOH & Fuel Oil Blend | % Recovery |
|---|---|---|
| 19 | 1.44 | 80.7 |

TABLE 3-continued

| Item # | Pounds TOH & Fuel Oil Blend | % Recovery |
|---|---|---|
| 18 | 1.80 | 86.3 |
| 17 | 2.16 | 90.3 |
| 16 | 2.52 | 93.1 |
| 21 | 3.06 | 94.9 |
| 20 | 3.59 | 94.4 |

This data is plotted in FIG. 1.

It will be appreciated that, in matters such as reagents and procedures, specific items have been described herein for purposes of illustration without any intention to be limited thereto. It will be evident that various changes may be made in those details without departing from the scope of the invention, as hereinafter defined.

What is claimed:

1. In a method for the flotation of phosphate ore in the presence of water containing an organic acid, oil;

the improvement wherein the organic acid is a half-ester of an organic dicarboxylic acid and at least one saturated aliphatic alcohol containing at least 11 carbon atoms.

2. A method as set forth in claim 1 in which the dicarboxylic acid is maleic acid.

3. A method as set forth in claim 1 in which caustic soda also is present, the amount of caustic soda being at most sufficient to raise the pH to 7.0.

* * * * *